US010260822B2

(12) United States Patent
Larsson

(10) Patent No.: US 10,260,822 B2
(45) Date of Patent: Apr. 16, 2019

(54) PLATE HEAT EXCHANGER WITH MOUNTING FLANGE

(71) Applicant: ALFA LAVAL CORPORATE AB, Lund (SE)

(72) Inventor: Håkan Larsson, Kävlinge (SE)

(73) Assignee: ALFA LAVAL CORPORATE AB, Lund (SE)

( * ) Notice: Subject to any disclaimer, the term of this patent is extended or adjusted under 35 U.S.C. 154(b) by 222 days.

(21) Appl. No.: 15/105,396

(22) PCT Filed: Dec. 11, 2014

(86) PCT No.: PCT/EP2014/077420
§ 371 (c)(1),
(2) Date: Jun. 16, 2016

(87) PCT Pub. No.: WO2015/091213
PCT Pub. Date: Jun. 25, 2015

(65) Prior Publication Data

US 2016/0313073 A1 Oct. 27, 2016

(30) Foreign Application Priority Data

Dec. 20, 2013 (EP) ..... 13198879

(51) Int. Cl.
*F28F 9/007* (2006.01)
*F28D 9/00* (2006.01)
(Continued)

(52) U.S. Cl.
CPC ..... *F28F 9/0075* (2013.01); *F28D 9/005* (2013.01); *F28F 9/002* (2013.01); *F28F 21/083* (2013.01);
(Continued)

(58) Field of Classification Search
CPC ..... F28F 9/0075; F28F 9/005; F28F 9/002; F28F 21/083; F28F 21/084;
(Continued)

(56) References Cited

U.S. PATENT DOCUMENTS 6,039,112 A 3/2000 Ruppel et al.
7,721,791 B2 5/2010 Hayasaka et al.
(Continued)

FOREIGN PATENT DOCUMENTS

CN 201081581 Y 7/2008
CN 201 285 244 Y 8/2009
(Continued)

OTHER PUBLICATIONS

English translation Valeo Systemes Thermiques (WO 2012/059152).*
(Continued)

*Primary Examiner* — Jianying Atkinsson
*Assistant Examiner* — Joel Attey
(74) *Attorney, Agent, or Firm* — Buchanan Ingersoll & Rooney PC

(57) ABSTRACT

A plate heat exchanger comprises a plate package of permanently connected heat exchanger plates that defines a surrounding wall. Two mounting plates are permanently connected to an end surface of the plate package, in spaced relation to each other. Each mounting plate comprises opposing flat engagement surfaces and a peripheral edge that forms a perimeter of the mounting plate. Each mounting plate is arranged with one of its engagement surfaces permanently connected to the end surface, such that the peripheral edge partially extends beyond the outer periphery of the end surface, to define a mounting flange, and partially extends across the end surface in contact with the same. The mounting plates have a decreasing thickness towards the
(Continued)

peripheral edge in predefined intersection regions, which are located where the peripheral edge intersects with the perimeter of the surrounding wall as seen in a normal direction to the end surface.

20 Claims, 7 Drawing Sheets

(51) Int. Cl.
*F28F 21/08* (2006.01)
*F28F 9/00* (2006.01)
*F28D 21/00* (2006.01)

(52) U.S. Cl.
CPC .... *F28F 21/084* (2013.01); *F28D 2021/0089* (2013.01); *F28F 9/005* (2013.01); *F28F 2225/00* (2013.01); *F28F 2230/00* (2013.01); *F28F 2275/025* (2013.01); *F28F 2275/04* (2013.01); *F28F 2275/06* (2013.01); *F28F 2280/06* (2013.01)

(58) Field of Classification Search
CPC ..... F28F 2225/00; F28F 2230/00; F28F 2275/025; F28F 2275/04; F28F 2275/06; F28F 2280/06; F28D 2021/0089
USPC ..... 165/67
See application file for complete search history.

(56) References Cited

U.S. PATENT DOCUMENTS

| | | | | |
|---|---|---|---|---|
| 8,181,695 | B2 | 5/2012 | Bradu et al. | |
| 8,181,696 | B2 | 5/2012 | Rassmus | |
| 2005/0284620 | A1 | 12/2005 | Thunwall et al. | |
| 2006/0115393 | A1* | 6/2006 | Reinke | B01J 19/249 422/198 |
| 2007/0084809 | A1 | 4/2007 | Bradu et al. | |
| 2008/0047689 | A1 | 2/2008 | Hirose et al. | |
| 2010/0258095 | A1 | 10/2010 | Saumweber et al. | |
| 2012/0152506 | A1 | 6/2012 | Otahal | |
| 2012/0255709 | A1* | 10/2012 | Kinder | F28F 9/002 165/67 |
| 2013/0092359 | A1 | 4/2013 | Von Eckermann et al. | |
| 2013/0219880 | A1 | 8/2013 | Irmler | |

FOREIGN PATENT DOCUMENTS

| | | | |
|---|---|---|---|
| CN | 201440047 | U | 4/2010 |
| CN | 102564177 | A | 7/2012 |
| DE | 19709601 | A1 | 9/1998 |
| DE | 10 2004 035448 | A1 | 2/2006 |
| EP | 0 347 961 | A1 | 12/1989 |
| EP | 1 189 009 | A1 | 3/2002 |
| EP | 2 267 390 | A2 | 12/2010 |
| JP | S6050394 | A | 3/1985 |
| JP | 2008-082672 | A | 4/2008 |
| KR | 10-2011-0076344 | A | 7/2011 |
| WO | 0246679 | A1 | 6/2002 |
| WO | WO 2011/009412 | A1 | 1/2011 |
| WO | 2012059152 | A1 | 5/2012 |
| WO | WO 2012/059152 | A1 | 5/2012 |

OTHER PUBLICATIONS

International Search Report (PCT/ISA/210) dated Feb. 13, 2015, by the Japanese Patent Office as the International Searching Authority for International Application No. PCT/EP2014/077420.
Written Opinion (PCT/ISA/237) dated Feb. 13, 2015, by the Japanese Patent Office as the International Searching Authority for International Application No. PCT/EP2014/077420.
Office Action (KIPO'S Notice of Preliminary Rejection) dated Sep. 8, 2017, by the Korean Patent Office in corresponding Korean Patent Application No. 10-2016-7019574, and an English Translation of the Office Action. (8 pages).
Official Action dated May 15, 2017 by the Japan Patent Office in counterpart Japanese Application No. 2016-541209, with English language translation of Official Action (7 pgs).
Office Action (First) dated Jun. 2, 2017, by the Chinese Patent Office in corresponding Chinese Patent Application No. 201480069440.0 and an English translation of the Office Action. (8 pgs).
Office Action dated Oct. 9, 2018, by the Swedish Patent and Registration Office in corresponding Swedish Patent Application No. 1650780-8. (7 pages).

* cited by examiner

PLATE HEAT EXCHANGER WITH MOUNTING FLANGE

TECHNICAL FIELD

The present invention relates to a plate heat exchanger that comprises a plurality of heat exchanger plates which are stacked and permanently connected to form a plate package and a mounting structure which is permanently connected to the plate package for releasable attachment of the plate heat exchanger to an external supporting structure.

BACKGROUND

Heat exchangers are utilized in various technical applications for transferring heat from one fluid to another fluid. Heat exchangers in plate configuration are well-known in the art. In these heat exchangers, a plurality of stacked plates having overlapping peripheral side walls are put together and permanently connected to define a plate package with hollow fluid passages between the plates, usually with different fluids in heat exchange relationship in alternating spaces between the plates. Usually a coherent base plate or mounting plate is directly or indirectly attached to the outermost one of the stacked plates. The mounting plate has an extension that exceeds the stack of plates so as to define a circumferential mounting flange. The mounting flange has holes or fasteners to attach the heat exchanger to a piece of equipment. This type of plate heat exchanger is e.g. known from US2010/0258095 and U.S. Pat. No. 8,181,695.

When fastened on the piece of equipment, the mounting plate may be subjected to a significant pressure and weight load which tends to deform the mounting plate. To achieve an adequate strength and rigidity, the mounting plate needs to be comparatively thick. Such a thick mounting plate may add significantly to the weight of the heat exchanger. Furthermore, the use of a thick mounting plate leads to a larger consumption of material and a higher cost for the heat exchanger.

The need for a thick mounting plate may be particularly pronounced when the heat exchanger is mounted in an environment which is subjected to vibrations. Such vibrations may e.g. occur when the plate heat exchanger is mounted in a vehicle such as a car, truck, bus, ship or airplane. In these environments, the design of the plate heat exchanger in general, and the design and attachment of the mounting plate in particular, need to take into account the risk for fatigue failure caused by cyclic loading and unloading of the mounting plate by the vibrations. The cyclic stresses in the heat exchanger may cause it to fail due to fatigue, especially in the joints between the plates, even if the nominal stress values are well below the tensile stress limit. The risk for fatigue failure is typically handled by further increasing the thickness of the mounting plate, which will make it even more difficult to keep down the weight and cost of the plate heat exchanger.

SUMMARY

It is an objective of the invention to at least partly overcome one or more limitations of the prior art.

Another objective is to provide a plate heat exchanger with a relatively low weight and a relatively high strength when mounted to an external supporting structure.

A further objective is to provide a plate heat exchanger that can be manufactured at low cost.

Yet another objective is to provide a plate heat exchanger suitable for use in environments subjected to vibrations.

One or more of these objects, as well as further objects that may appear from the description below, are at least partly achieved by a plate heat exchanger according to the independent claim, embodiments thereof being defined by the dependent claims.

A first aspect of the invention is a plate heat exchanger, comprising: a plurality of heat exchanger plates which are stacked and permanently connected to form a plate package that defines first and second fluid paths for a first medium and a second medium, respectively, separated by said heat exchanger plates, said plate package defining a surrounding external wall that extends in an axial direction between first and second axial ends; an end plate permanently connected to one of the first and second axial ends so as to provide an end surface that extends between first and second longitudinal ends in a lateral plane which is orthogonal to the axial direction; and two mounting plates permanently connected to a respective surface portion of the end surface at the first longitudinal end and the second longitudinal end, respectively, such that the mounting plates are spaced from each other in a longitudinal direction on the end surface, wherein the respective mounting plate comprises opposing flat engagement surfaces and a peripheral edge that forms an perimeter of the mounting plate. The respective mounting plate is arranged with one of its engagement surfaces permanently connected to the end surface, wherein the peripheral edge partially extends beyond the outer periphery of the end surface, so as to define a mounting flange, and partially extends across the end surface in contact with the same. The mounting plate has a decreasing thickness towards the peripheral edge in predefined intersection regions, which are located where the peripheral edge intersects with the perimeter of the surrounding external wall as seen in a normal direction to the end surface.

The inventive plate heat exchanger is based on the insight that the coherent mounting plate of the prior art may be replaced by two smaller mounting plates that are located at a respective longitudinal end on the end surface on the plate package to provide a respective mounting flange for the heat exchanger. The use of two smaller, separated mounting plates may reduce the weight of the heat exchanger, and also its manufacturing cost, since material is eliminated in the space between the mounting plates, beneath the end surface of the plate package. The inventive heat exchanger is furthermore based on the insight that the use of two separated mounting plates may lead to local stress concentration in the heat exchanger, which may act to reduce the heat exchanger's ability to sustain loads, and in particular cyclic loads. The concentration of stress has been found to originate in the intersection regions on the mounting plate. The respective mounting plate is therefore configured with a decreasing thickness towards the peripheral edge in these intersection regions. Thus, the mounting plate is locally thinned in confined regions at and near its perimeter, as seen in plan view towards the end surface. This results in a locally increased flexibility in the material of the mounting plate without significantly reducing the strength and stiffness of the mounting plate as a whole. The locally increased flexibility serves to distribute the load that is transferred to the mounting plates, the end plate and the plate package via the mounting flanges. The inventive heat exchanger may therefore be designed to achieve a more uniform distribution of stress in the plates of the heat exchanger and in the joints between these plates.

The distribution of stress may be controlled further by optimizing the design parameters of the heat exchanger in general, and the mounting plates in particular, for example according to the following embodiments.

In one embodiment, the respective intersection region has a predefined cross-sectional shape which connects the engagement surfaces by reducing the thickness of the mounting plate from a first thickness, given by the distance between the engagement surfaces, to a second thickness at the peripheral edge. The cross-sectional shape may comprise a portion with continuously decreasing thickness towards the peripheral edge and may comprise a concave portion. In one implementation, the cross-sectional shape comprises a corner portion having a radius, where the ratio between the radius and the first thickness may be in the range of about 0.2-1. Additionally or alternatively, the cross-sectional shape may comprise at least one of a bevel and a plurality of steps.

In one embodiment, the decreasing thickness is formed by recesses in the respective mounting plate, wherein the respective recess is formed to extend within each of the predefined intersection regions between the engagement surface that faces away from the end surface and the peripheral edge, as seen in the normal direction to the end surface. The respective recess may extend along the peripheral edge, as seen in the normal direction to the end surface. Further, the mounting plate may comprise, intermediate the recesses along the peripheral edge, a peripheral edge surface which joins and is essentially perpendicular to the opposing engagement surfaces, and the recesses may be located along a shoulder between the engagement surface that faces away from the end surface and the peripheral edge surface.

In one embodiment, the respective recess defines a border line to the engagement surface that faces away from the end surface, said border line defining an intersection point with the perimeter of the surrounding external wall, as seen in the normal direction to the end surface, wherein the tangent of the border line at the intersection point defines an angle $\alpha$ that exceeds 0°, and preferably is at least 1°, 5° or 10°, to a transverse direction, which is orthogonal to the longitudinal direction, in the plane of the mounting plate. Further, the recess may have essentially the same cross-sectional shape, as seen at right angles to the border line, along the border line. Alternatively or additionally, the border line may comprise or be an essentially straight line that defines said tangent.

In one embodiment, the respective recess extends from the intersection region into the mounting flange.

In one embodiment, the end plate is a sealing plate which is permanently and sealingly connected to one of the heat exchanger plates at one of said first and second axial ends.

In an alternative embodiment, the end plate is a reinforcement plate which is permanently connected to a sealing plate on the plate package, wherein the end plate has at least two supporting flanges that extend beyond the perimeter of the surrounding external wall so as to abut on the mounting flange defined by the respective mounting plate. Further, the end plate may comprise, along its perimeter and as seen in the normal direction of the end surface, concave or beveled surfaces adjacent to the supporting flanges, wherein the concave or beveled surfaces may be located to overlap the peripheral edge of the respective mounting plate in the proximity of the intersection regions, and the respective concave or beveled surface may be non-perpendicular to the peripheral edge at the overlap, as seen in the normal direction to the end surface.

In one embodiment, at least one of the mounting plates defines at least one through hole that extends between the engagement surfaces and is aligned with a corresponding through hole defined in the end plate and an internal channel defined in the plate package, so as to form an inlet or an outlet for the first or the second medium.

In one embodiment, the mounting flange comprises a plurality of mounting holes adapted to receive bolts or pins for fastening the plate heat exchanger.

In one embodiment, the heat exchanger plates are permanently joined to each other through melting of metallic material.

Still other objectives, features, aspects and advantages of the present invention will appear from the following detailed description, from the attached claims as well as from the drawings.

BRIEF DESCRIPTION OF DRAWINGS

Embodiments of the invention will now be described in more detail with reference to the accompanying schematic drawings.

DETAILED DESCRIPTION OF EXAMPLE EMBODIMENTS

Figure 1:
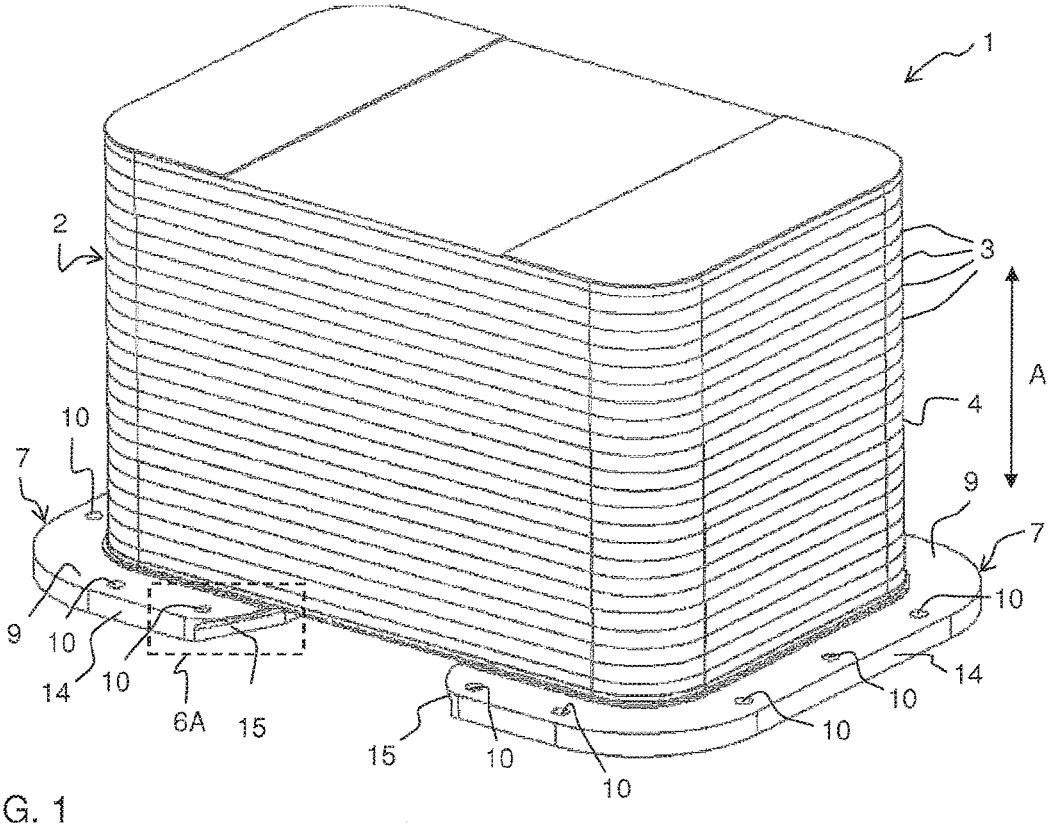
FIG. 1 is a perspective view of a plate heat exchanger according to an embodiment of the invention.

Embodiments of the present invention relate to configurations of a mounting structure on a plate heat exchanger. Corresponding elements are designated by the same reference numerals.

Figure 2:
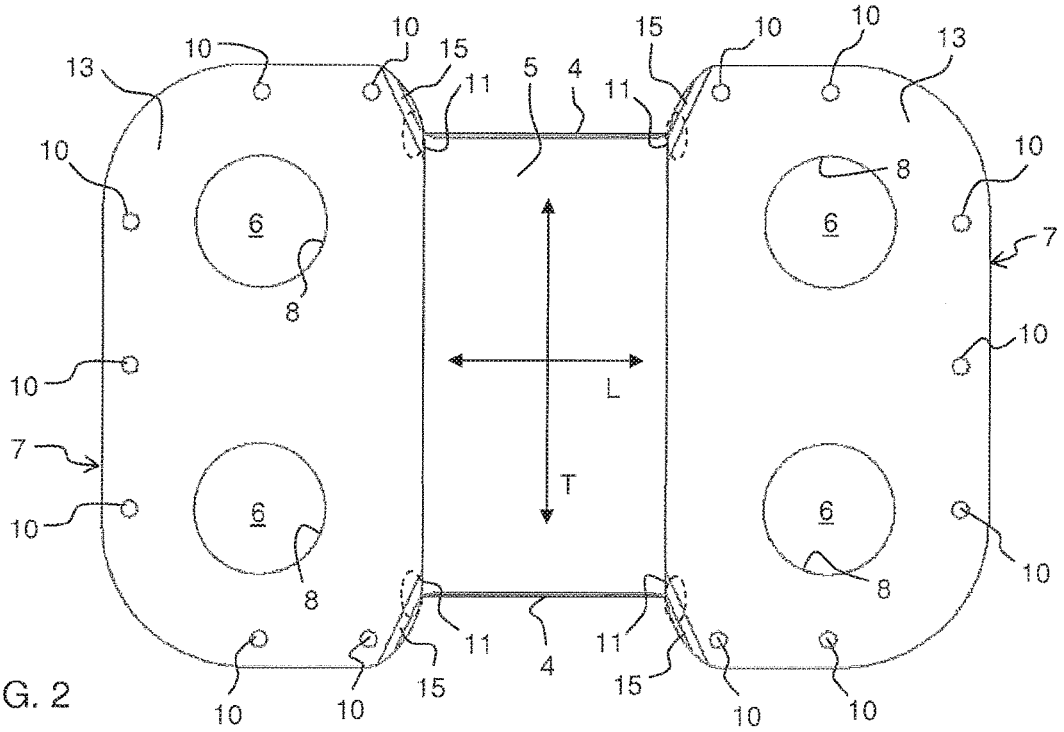
FIG. 2 is a bottom plan view of the plate heat exchanger in FIG. 1.

FIGS. 1-2 disclose an embodiment of a plate heat exchanger 1 according to the invention. The plate heat exchanger 1 comprises a plurality of plates which are stacked one on top of the other to form a plate package 2. The plate package 2 may be of any conventional design. Generally the plate package 2 comprises a plurality of heat exchanger plates 3 with corrugated heat transfer portions that define flow passages (internal channels) for a first and second fluid between the heat exchanger plates 3 such that heat is transferred through the heat transfer portions from one fluid to the other. The heat exchanger plates 3 may be single-walled or double-walled. The heat exchanger plates 3 are only schematically indicated in FIG. 1, since they are well-known to the person skilled in the art and their configuration is not essential for the present invention. The plate package 2 has the general shape of a rectangular cuboid, albeit with rounded corners. Other shapes are conceivable. Generally, the plate package 2 defines a surrounding external wall 4 which extends in a height or axial direction A between a top axial end and a bottom axial end. The wall 4 has a given perimeter or contour at its bottom axial end. In the illustrated example, the wall 4 has essentially the same contour along its extent in the axial direction A. The bottom axial end of the plate package 2 comprises or is provided with an essentially planar end surface 5 (FIG. 2), which may but need not conform to the contour of the wall 4 at the bottom axial end. The end surface 5 extends in a lateral plane. Generally, the plate package 2, and the end surface 5, extends between two longitudinal ends in a longitudinal direction L and between two transverse ends in a transverse direction T (FIG. 2).

Although not shown on the drawings, the heat transfer plates 3 have in their corner portions through-openings, which form inlet channels and outlet channels in communication with the flow passages for the first fluid and the second fluid. These inlet and outlet channels open in the end surface 5 of the plate package 2 to define separate portholes for inlet and outlet of the first and second fluids, respectively. In the illustrated example, the end surface 5 has four portholes 6 (FIG. 2).

The plate package 2 is permanently connected to two identical (in this example) mounting plates 7, which are arranged on a respective end portion of the end surface 5. The mounting plates 7 are thereby separated in the longitudinal direction L, leaving a space free of material beneath the center portion of the plate package 2. Compared to using a single mounting plate that extends beneath the entire plate package 2, the illustrated configuration saves weight and material of the heat exchanger 1, and thereby also cost. Each mounting plate 7 has two through-holes 8 which are mated with a respective pair of the portholes 6 of the plate package 2 to define inlet and outlet ports of the heat exchanger 1. The mounting plates 7 are configured for attaching the heat exchanger 1 to an external suspension structure (not shown) such that the inlet and outlet ports mate with corresponding supply ports for the first and second medium on the external structure. Optionally, one or more seals (not shown) may be provided in the interface between the mounting plate 7 and the external structure.

Each mounting plate 7 defines a mounting flange 9 that projects from the wall 4 and extends around the longitudinal end of the plate package 2. Bores 10 are provided in the mounting flange 9 as a means for fastening the heat exchanger 1 to the external structure. Threaded fasteners or bolts, for example, may be introduced into the bores 10 for engagement with corresponding bores in the external structure.

The plate package 2 and the mounting plates 7 are made of metal, such as stainless steel or aluminum. All the plates in the heat exchanger 1 are permanently connected to each other, preferably through melting of a metallic material, such as brazing, welding or a combination of brazing and welding. The plates in the plate package 2 may alternatively be permanently connected by gluing.

The mounting plates 7 are dimensioned, with respect to material, thickness and extent in the longitudinal and transverse directions, so as to have an adequate strength and stiffness to the static load that is applied to the mounting plates 7 when fastened on the external structure. The static load, which tends to deform the mounting plates 7, may originate from a combination of the weight of the heat exchanger 1, internal pressure applied by the media in the heat exchanger 1 and transferred to the mounting plates 7, and compression forces applied to the mounting plates 7, e.g. at the above-mentioned seals, via the fasteners and the bores 10. This static load tend to deform the mounting plates 7. As seen in FIGS. 1-2, the mounting plates 7 are generally designed to have a significant thickness. As a non-limiting example, the thickness may be 15-40 mm. The bottom of the plate package 2, on the other hand, is normally made of much thinner material.

If the heat exchanger 1 is installed in an environment where vibrations are transferred to the mounting plate 7 via the external structure, the heat exchanger 1 also needs to be designed to account for the mechanical stresses caused by the cyclic loading of the vibrations, i.e. cyclic stresses. For example, such vibrations occur for heat exchangers that are mounted in vehicles, such as cars, trucks and ships. In one non-limiting example, the heat exchanger 1 is an oil cooler for an engine. When cyclic stresses are applied to a material, even though the stresses do not cause plastic deformation, the material may fail due to fatigue especially in local regions with high stress concentration. The use of stiff thick mounting plates 7 connected to a plate package 2 with a relatively thin bottom is likely to lead to high concentrations of cyclic stress at the interface between the mounting plates 7 and the plate package 2, and possibly also within the plate package 2.

Embodiments of the present invention are designed to counteract stress concentration that may lead to fatigue failure. To this end, the mounting plates 7 are generally designed with a reduced thickness of the mounting plate 7 in selected intersection regions 11, which are located at and around the point where the perimeter of the mounting plate 7 intersects with the perimeter of the wall 4 of the plate package 2, as seen in plan view (FIG. 2). As used herein, the "perimeter" designates the outer contour. The perimeter of the mounting plate 7, as seen in the normal direction to the end surface 5, is also denoted "peripheral edge" herein. Specifically, each intersection region 11 includes the intersection point and spans an area where the mounting plate 7 overlaps and is attached to the plate package 2. The heat exchanger 1 in FIGS. 1-2 has four intersection regions 11, which are approximately indicated by dashed lines in FIG. 2. The intersection regions 11 typically extend about 5-20 mm from the intersection point in the plane of the mounting plate 7. By thinning the mounting plate 7 in the intersection regions 11, a locally increased flexibility is achieved in each such region 11 without significantly impairing the stiffness of the mounting plate 7 as a whole. The flexibility results in a favorable load transfer in the interface between the mounting plate 7 and the plate package 2.

Figure 3A:
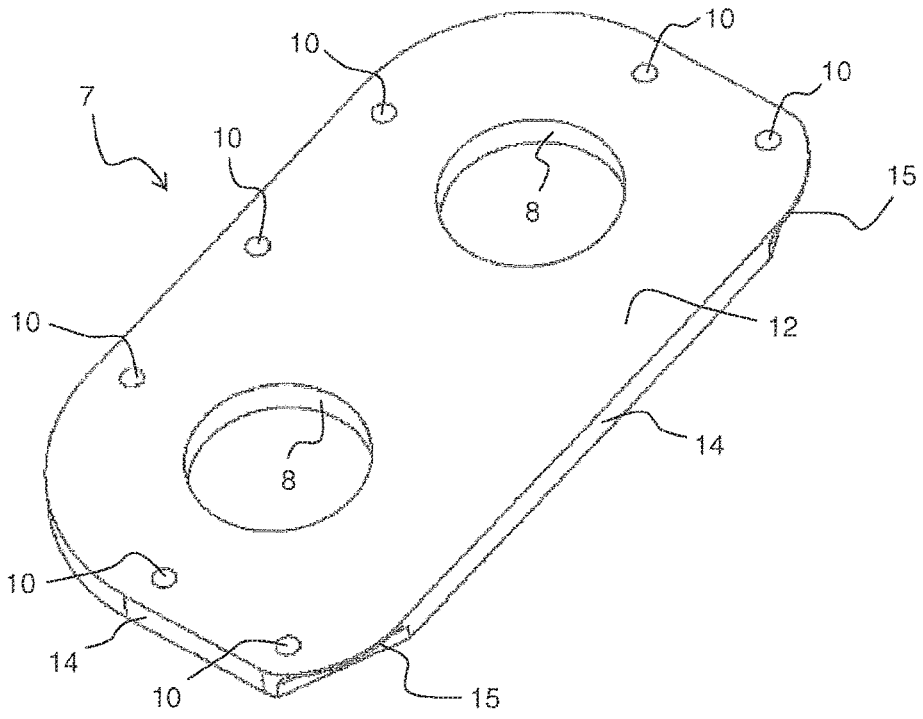
FIGS. 3A-3B are perspective views from two directions of a mounting plate included in the plate heat exchanger in FIG. 1.
Figure 3B:
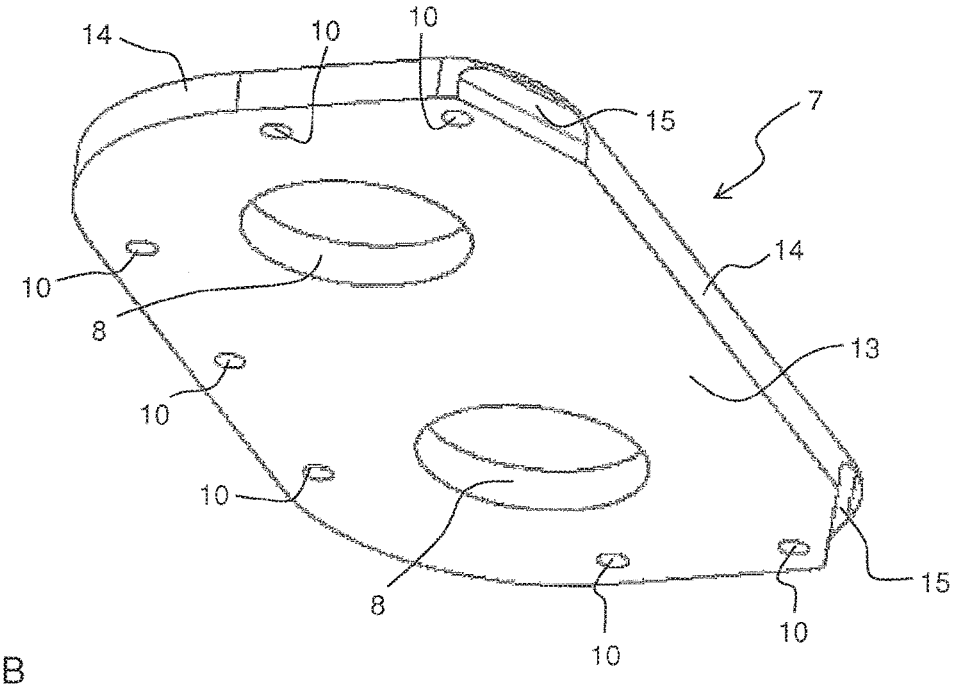
Figure 4:
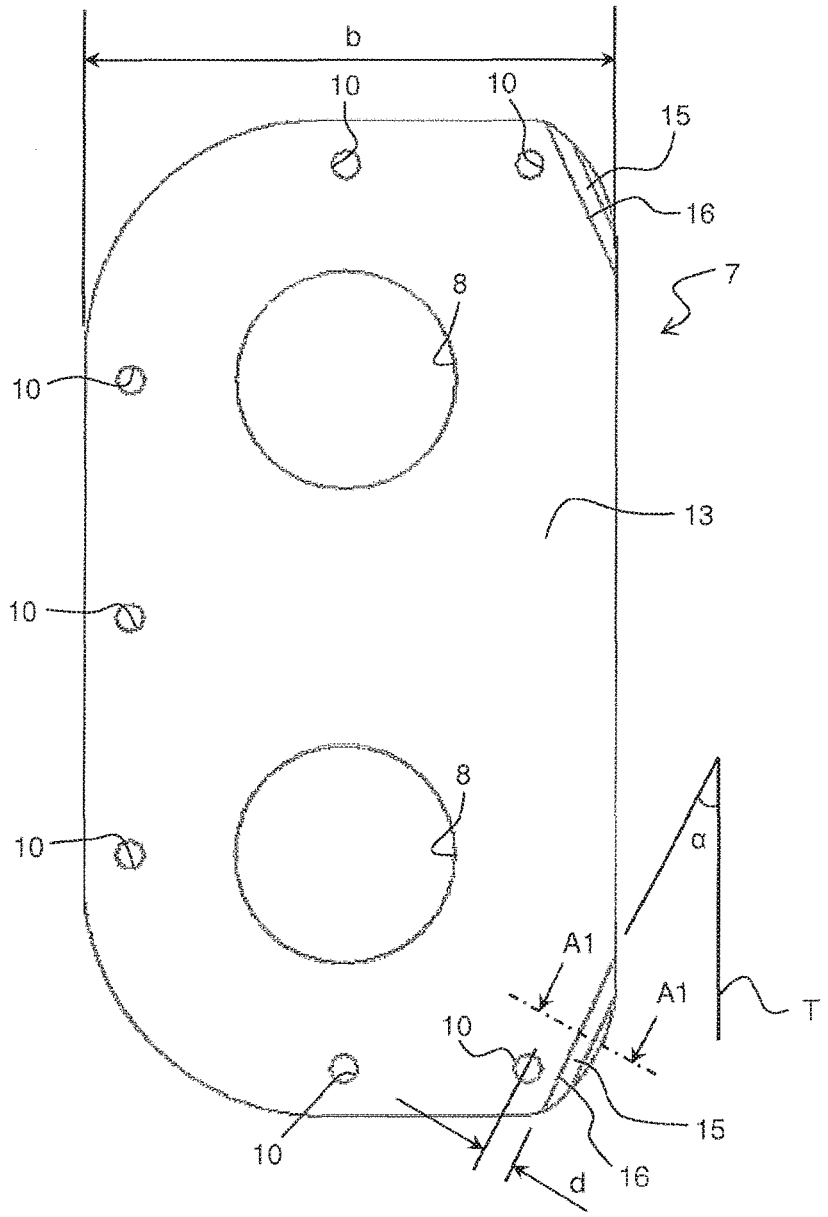
FIG. 4 is a bottom plan view of the mounting plate in FIGS. 3A-3B.

FIGS. 3A, 3B and 4 illustrate a mounting plate 7 in more detail. The mounting plate 7 has a generally elongated shape with rounded corner portions, as seen in plan view. The mounting plate 7 has essentially planar top and bottom surfaces 12, 13, where the top surface 12 forms an engagement surface to be permanently connected to the end surface 5 on the plate package 2, and the bottom surface 13 forms an engagement surface to be applied and fixed to the external supporting structure. The through-holes 8 and bores 10 are formed to extend between the top and bottom surfaces 12, 13. At the perimeter of the mounting plate 7, the top and bottom surfaces are connected by a peripheral edge surface 14. The edge surface 14 is essentially planar and right-angled to the top and bottom surfaces 12, 13 except for two elongated recesses or cuts 15 that are formed at two corner portions of the mounting plate 7. The recesses 15 result in a local and gradual reduction of the thickness of the mounting plate 7 towards its perimeter at the corner portions. As seen in FIG. 2, the recesses 15 are provided on the mounting plate 7 such that they overlap with the wall 4 that defines the perimeter of the plate package 2. In other words, the recesses 15 are arranged to locally increase the flexibility of the mounting plate 7 in a respective intersection region 11.

In the illustrated embodiment, the respective recess 15 is elongated and extends across the entire rounded corner portion of the mounting plate 7. The recess 15 extends essentially parallel to the top surface 12 and defines a linear cut line or border line 16 on the bottom surface 13, as shown in FIG. 4. The cut line 16 defines an angle $\alpha$ to the transverse direction T of the plate package 2. The present Applicant has found that both the extent of the recess 15 and the angle $\alpha$ may be optimized to achieve a desired distribution of stress in the interface between the mounting plate 7 and the plate package 2. Specifically, it may be advantageous for the recess 15 to extend outside the perimeter of the plate package 2, i.e. into the mounting flange 9 (FIG. 1). Furthermore, it may be advantageous for the angle $\alpha$ to exceed 0°. It is currently believed that the distribution of stress is improved with increasing angle $\alpha$, up an angle of 90°. However, the angle may be limited by other design considerations, and in practice the angle $\alpha$ may be at least 1°, at least 5°, or at least 10°. It should be noted that the placement of the bores 10 may be fixed if they are to be matched with corresponding bores, bolts, pins or other fasteners on the external structure. In such a situation, it may be necessary to design the mounting plate 7 with an increased width b in the longitudinal L direction so as to be able to accommodate a recess 15 with a given extent and angle while leaving sufficient material between the recess 15 and the nearest bore 10. As shown in FIG. 4, the recess 15 is angled to leave a distance d in the plane of the mounting plate 7 between the cut line 16 and the center of nearest bore 10.

Figure 9A:
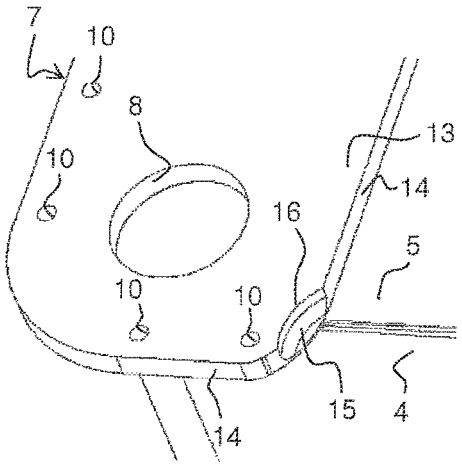
FIGS. 9A-9B are perspective and bottom plan views of a first alternative configuration of a recessed mounting plate.
Figure 9B:
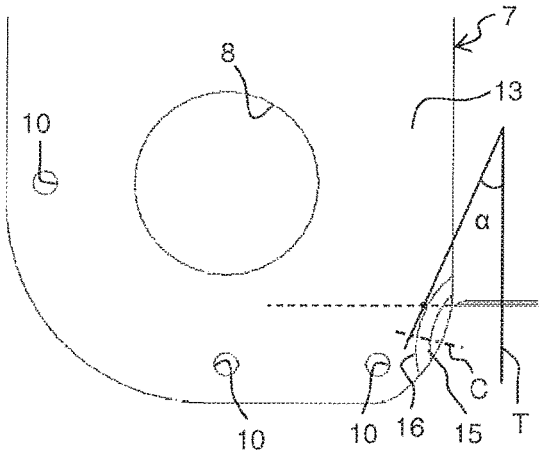

It should be noted that the recess 15 need not define a linear cut line 16 with the bottom surface 13. FIGS. 9A-9B illustrate part of a heat exchanger with a smaller recess 15 in the mounting plate 7. The recess 15 defines a curved cut line 16 on the bottom surface 13 and extends only about halfway across the corner portion of the mounting plate 7. The angle $\alpha$ is defined with respect to the intersection point (marked by a black dot) between the surrounding wall 4 and the cut line 16, as seen from the bottom of the heat exchanger. In FIG. 9B, the surrounding wall 4 is partly hidden behind the mounting plate 7 and the location of the wall 4 is indicated by a dashed line. The angle $\alpha$ is defined as the angle, in the plane of the mounting plate 7, between the transverse direction T and the tangent of the cut line 16 at the intersection point. As noted above, this angle $\alpha$ is a design parameter that may be set to exceed 0°, and preferably to be at least 1°, 5° or 10°. This definition and choice of the angle $\alpha$ is applicable to all embodiments shown herein.

Figure 9C:
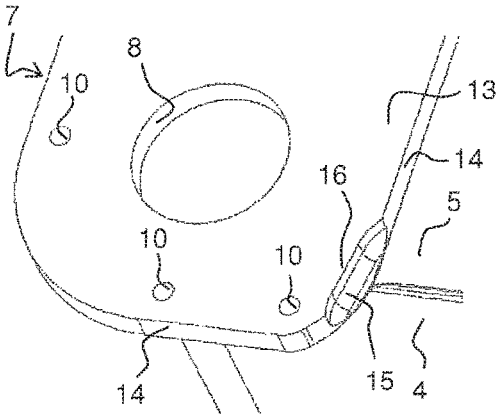
FIGS. 9C-9D are perspective and bottom plan views of a second alternative configuration of a recessed mounting plate.
Figure 9D:
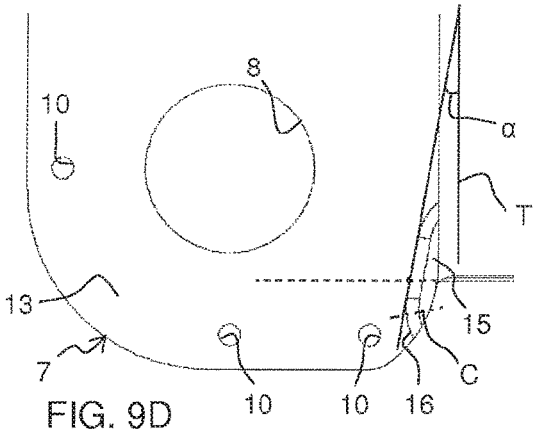

FIGS. 9C-9D illustrate a variant in which the recess 15 defines a cut line 16 with a linear center portion bounded by curved end parts. The linear center portion causes the recess to extend further beneath the plate package 2.

Figure 9E:
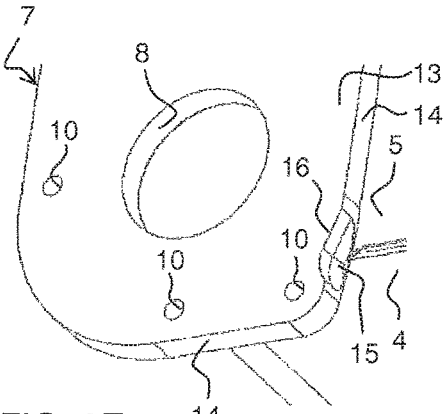
FIGS. 9E-9F are perspective and bottom plan views of a third alternative configuration of a recessed mounting plate.
Figure 9F:
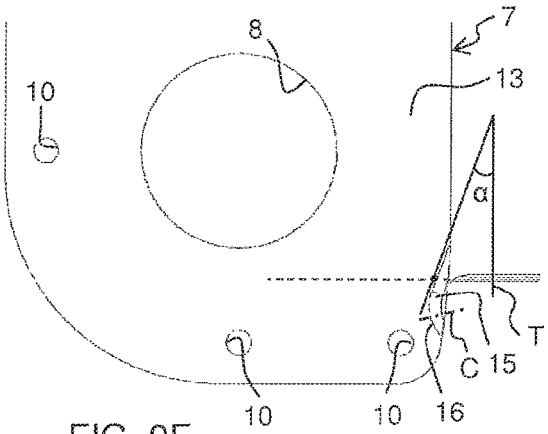

FIGS. 9E-9F illustrate another implementation in which the mounting plate 7 has smaller width (cf. b in FIG. 4). Compared to the mounting plate 7 in FIGS. 9A-9D, there is less material around the nearest bore 10, and the recess 15 cannot extend into the corner portion. The recess 15 defines a cut line 16 with a linear portion that extends beneath the plate package 2 and a curved end portion in the mounting flange 9.

Figure 9G:
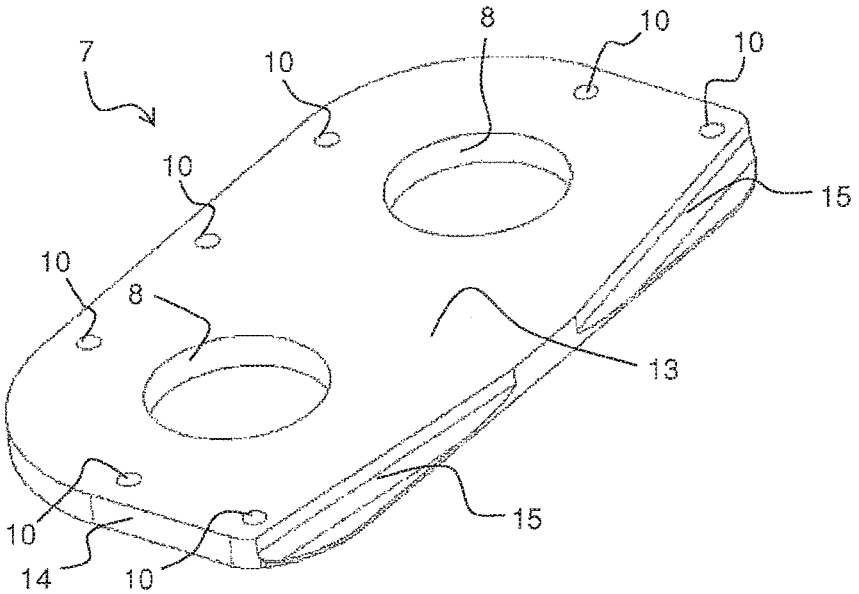
FIG. 9G is a perspective view of a fourth alternative configuration of a recessed mounting plate.

Although all illustrated examples involve recesses 15 that extend into the mounting flange 9, it may be possible to achieve a sufficient stress distribution by confining the recesses 15 entirely within the perimeter of the wall 4. It is also conceivable for the recesses 15 to be much longer so as to extend not only in the mounting flange 9 but also further beneath plate package 2. The two recesses 15 may even meet beneath the plate package 2. One embodiment of this type is shown in FIG. 9G. However, a recess 15 that extends significantly beneath plate package 2 may reduce the strength of the mounting plate 7 without significantly contributing to a more uniform distribution of stress.

The mounting plate 7 may be initially manufactured with a coherent edge surface 14, e.g. planar and right-angled as shown in FIGS. 3A-3B, and the recesses 15 may be provided by locally removing a respective portion around the shoulder between the bottom surface 13 and the edge surface 14. The recesses 15 may be formed by machining, e.g. milling, grinding, boring or drilling.

Figure 5:
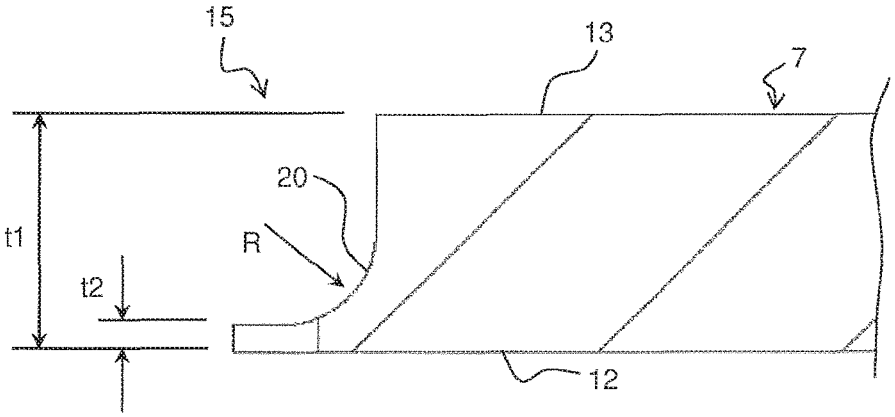
FIG. 5 is a section view along the line A1-A1 in FIG. 4.

Reverting to FIG. 4, the respective recess 15 is formed with a cross-section that is generally tapered towards the perimeter of the mounting plate 7. FIG. 5, which is taken along the line A1-A1 in FIG. 4, shows the cross-section of the mounting plate 7 at the location of the recess 15. As seen, the recess 15 defines a transition 20 from a major thickness t1 of the mounting plate 7 to a minor thickness t2 at the peripheral edge. The transition 20 is generally concave and has curved inner corner portion. In this example, the inner corner portion is surrounded by essentially straight portions. The inner corner portion is formed as a circular curve with a predefined radius R. Calculations indicate that the ratio of the radius R to the major thickness t1 may be in the range of about 0.2-1.0 to achieve desirable results. The cross-section in FIG. 5 is taken at right angles to the cut line 16. For ease of manufacture and/or estimation of the stress distribution (below), the cross-section at right angles to the cut line 16 may (but need not) be the same along the recess 15, i.e. along the cut line 16. This is applicable to all examples of recesses shown herein, and thus FIG. 5 may also illustrate the cross-section along line C in FIG. 9B, FIG. 9D and FIG. 9F.

Figure 6A:
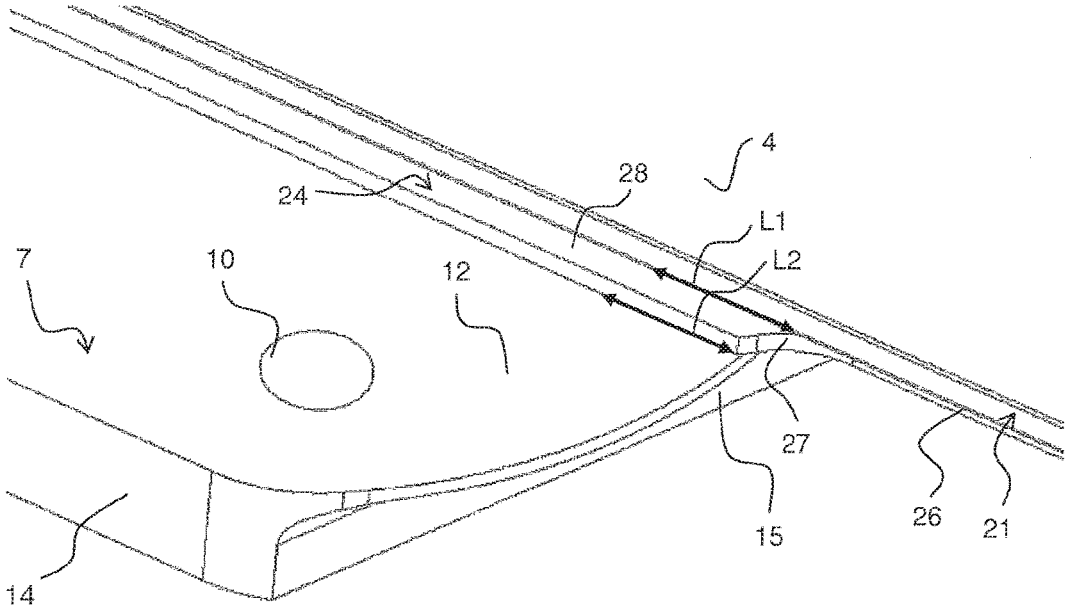
FIG. 6A is an enlarged view of a portion in FIG. 1 to illustrate a juncture between the mounting plate, a reinforcement plate and a sealing plate in the plate heat exchanger.
Figure 7:
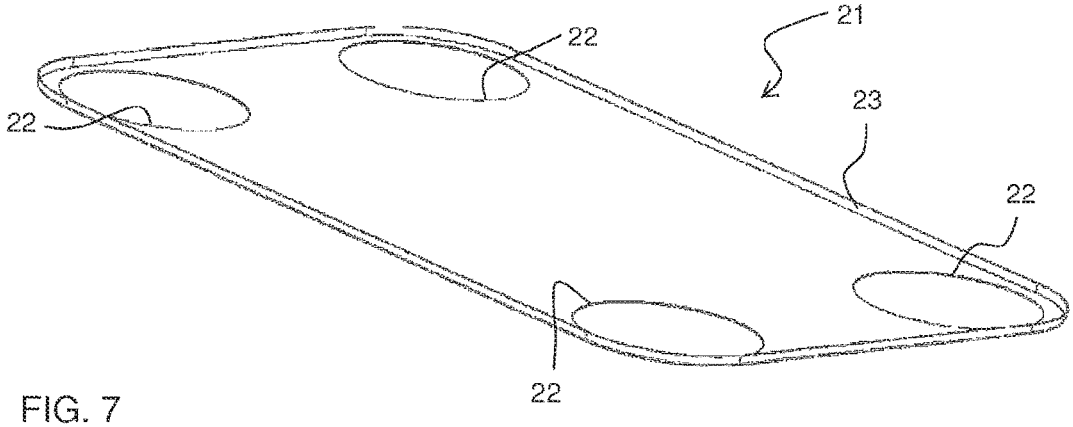
FIG. 7 is a perspective view of a sealing plate included in the plate heat exchanger of FIG. 1.

The heat exchanger 1 in FIG. 1 comprises some additional features that may serve to improve stability and durability. FIG. 6A shows the juncture between the mounting plate 7 and the plate package 2 in greater detail and is taken within the dashed rectangle 6A in FIG. 1. In this example, a sealing plate 21 is connected to the stack of heat exchanger plates to define a bottom surface of the plate package 2. The sealing plate 21, as shown in FIG. 7, is generally planar and has through-holes 22 at its corners to be mated with corresponding through-holes in the heat exchanger plates 3. The perimeter of the sealing plate 21 is bent upwards to form a surrounding flange 23 which adapted to abut on and be fixed to a corresponding flange of an overlying heat exchanger plate, as is known in the art. Thus, the perimeter of the sealing plate 21 generally conforms to the perimeter of the surrounding wall 4, although the surrounding flange 21 may project slightly beyond the perimeter of the surrounding wall 4 as defined by the heat exchanger plates. In certain embodiments, the mounting plates 7 may be directly attached to the sealing plate 21. In such embodiments, the sealing plate 21 is an end plate that defines the end surface 5.

Figure 8:
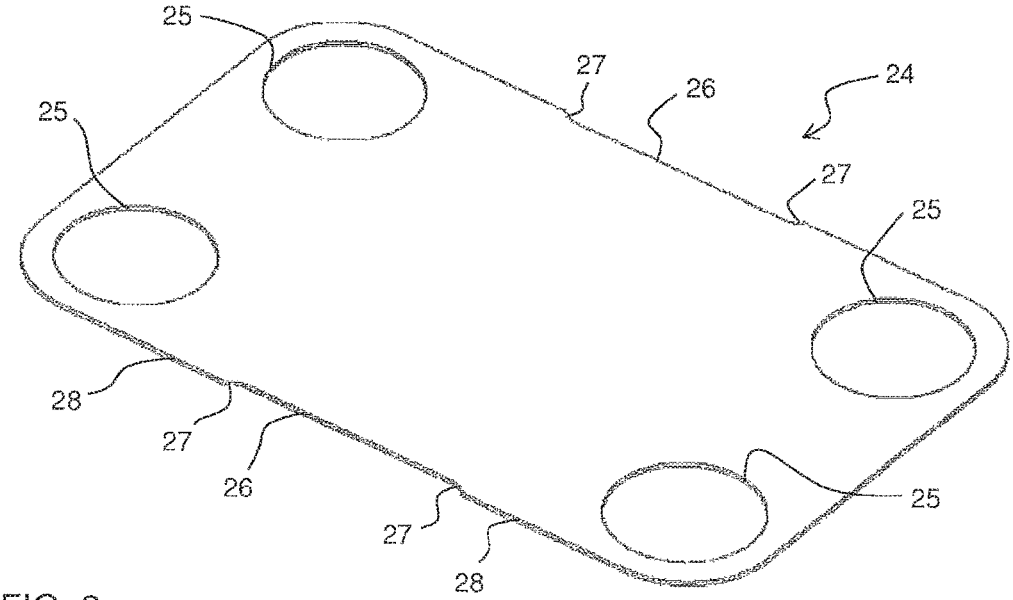
FIG. 8 is a perspective view of a reinforcement plate included in the plate heat exchanger of FIG. 1.

However, in the illustrated embodiment, an additional plate 24 is attached intermediate the sealing plate 21 and the mounting plate 7 for the purpose of reinforcing the bottom surface of the plate package 2. Thus, the end surface 5 is defined by this additional reinforcement or supporting plate 24. The use of such a reinforcement plate 24 may be advantageous when the working pressure of one or both of the media conveyed through the heat exchanger 1 is high or when the working pressure for one or both of the media varies over time. The reinforcement plate 24, which is shown in greater detail in FIG. 8, has a uniform thickness and defines through-holes 25 which are matched to the portholes in the plate package 2. The perimeter of the reinforcement plate 24 may be essentially level with the perimeter of the sealing plate 21 or the perimeter of the wall 4 of the plate package 2. However, in the illustrated example, the reinforcement plate 24 is adapted to locally project from the perimeter of the wall 4 and thus from the perimeter of the sealing plate 21. Specifically, the reinforcement plate 24 is provided with cutouts 26 that are located to extend in the longitudinal direction between the intersection regions 11 on a respective transverse side of the plate package 2 so as to be essentially level with the axial wall 4. Thereby, the longitudinal end points of the cutouts 26 define a respective transition 27 to a projecting tab portion 28, where the transitions 27 are located to overlap the perimeter of the mounting plate 7 in proximity to the intersection regions 11 and are shaped to be non-perpendicular to the perimeter of the mounting plate 7 at the overlap, as seen in a direction towards the bottom of the heat exchanger 1. This configuration of the reinforcement plate 24 will locally decrease the stress in the reinforcement plate 24 next to the intersection regions 11. The transitions 27 may e.g. form a bevel or a curve from the cutout 26 to the tab 28. In the illustrated example, see FIG. 6A, the tab portions 28 protrude from the plate package 2 to essentially co-extend with and abut against a respective mounting plate 7. This has been found to result in a favorable distribution of stress between the mounting plate 7, the reinforcement plate 24 and the sealing plate 21 especially at the corners of the plate package 2. It will also increase the strength of the joint between the reinforcement plate 24 and the mounting plate 7 due to the increased contact area between them. In an alternative implementation, not shown, the reinforcement plate 24 projects from the plate package 2 around its entire perimeter except for small notches that are located in the proximity of the intersection regions 11 to provide transitions 27 that are appropriately shaped to be non-perpendicular to the perimeter of the mounting plate 7.

The design of the mounting plate 7, and the reinforcement plate 24 if present, may be optimized based on the general principles outlined above, by simulating the distribution of stress in the heat exchanger structure. Such simulations may serve to adapt one or more of the thickness t1 of the mounting plates 7, the width b of the mounting plates 7, the cross-section of the recess 15, the extent of the recess 15, and the angle $\alpha$ of the recess 15. The simulations may be based on any known technique for numerical approximations of stress, such as the finite element method, the finite difference method, and the boundary element method.

Figure 6B:
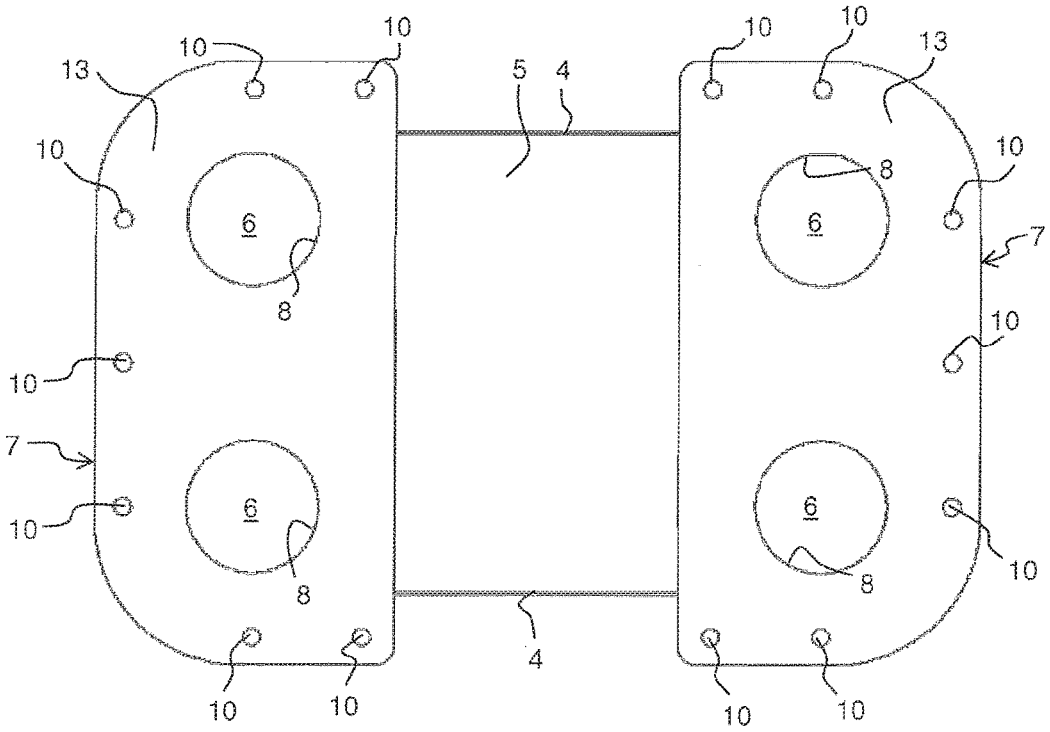
FIG. 6B is a bottom plan view of a plate heat exchanger having mounting plates with uniform thickness around their perimeter.
Figure 6C:
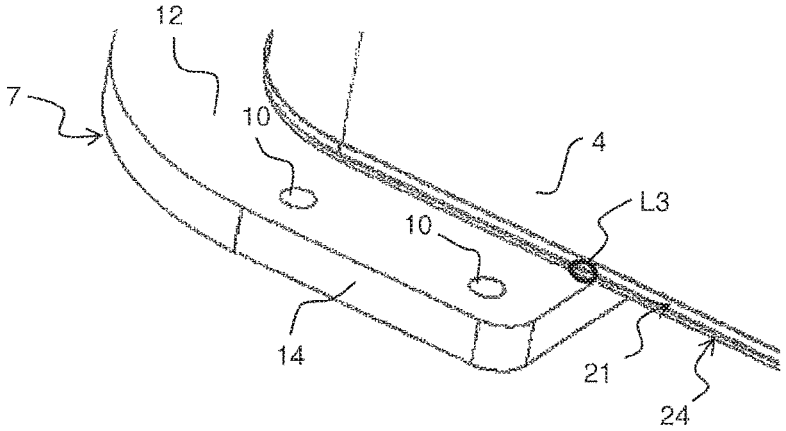
FIG. 6C is an enlarged view of a juncture between a mounting plate and an end plate in the plate heat exchanger of FIG. 6B.

A simulation of the stress distribution within the structure in FIG. 6A, for one specific vibration load condition, indicates that stresses are well-distributed without any significant peaks in the interface between the mounting plate 7 and the reinforcement plate 24, along arrow L1, with a maximum stress value of about 65 N/mm$^2$ (MPa). The simulation also indicates a corresponding magnitude and distribution of stress in the interface between the reinforcement plate 24 and the sealing plate 21, along arrow L2. For comparison, the stress distribution has also been simulated, for the same vibration load condition, within a heat exchanger provided with a mounting plate 7 without any recesses in the intersection regions. This heat exchanger 1 is shown in bottom plan view in FIG. 6B. As seen, the respective mounting plate 7 has a uniform thickness throughout its extent, also where the perimeter of the mounting plate 7 intersects the perimeter of the wall 4 of the plate package 2. In this example, the reinforcement plate 24 has the same extension as the sealing plate 21. FIG. 6C is an enlarged perspective view of the intersection region. The simulation indicated a significant stress concentration at the juncture of the mounting plate 7 and the reinforcement plate 24, with a maximum stress value of about 310 N/mm$^2$ in region L3.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

Figure 10A:
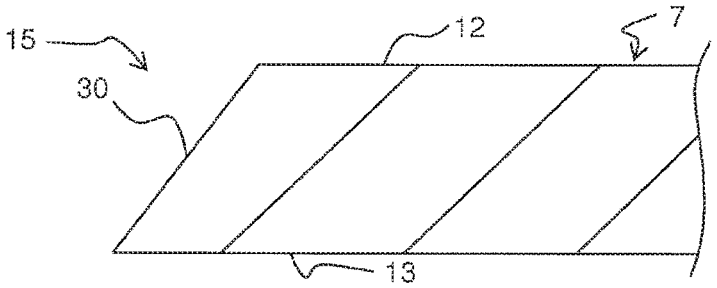
FIGS. 10A-10C illustrate, in cross-section, alternative configurations for providing a reduced peripheral thickness of a mounting plate in the plate heat exchanger of FIG. 1.
Figure 10B:
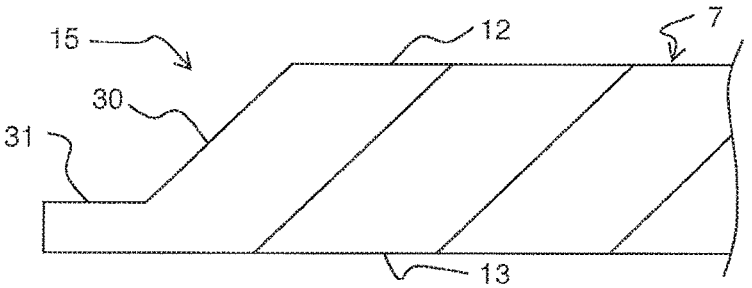
Figure 10C:
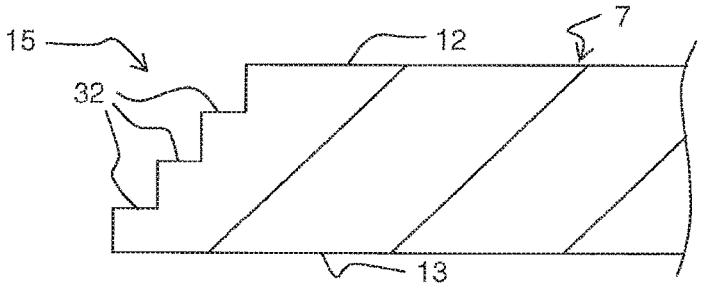

For example, the cross-section of the recesses 15 may deviate from the one shown in FIG. 5. One alternative cross-section is shown in FIG. 10A, where the recess 15 is formed as a bevel 30 that extends linearly from the bottom surface 13 to the top surface 12, to produce a pointed peripheral edge. In FIG. 10B, the cross-section is formed as a bevel 30 that extends linearly from the bottom surface 13 to a location inward of the peripheral edge to produce a distal lip 31 of uniform thickness. In FIG. 100, the recess is formed as a sequence of multiple steps 32 towards the peripheral edge. Although not shown in FIG. 100, each step 32 may be provided with a rounded inner corner portion, similar to the cross-section in FIG. 5.

As used herein, "top", "bottom", "vertical", "horizontal", etc merely refer to directions in the drawings and does not imply any particular positioning of the heat exchanger 1. Nor does this terminology imply that the mounting plates 7 need to be arranged on any particular end of the plate package 2. Reverting to FIG. 1, the mounting plates may alternatively be arranged on the top axial end of the plate package 2 and may be permanently connected either to a sealing plate or to a reinforcement plate overlying the sealing plate. Furthermore, the mounting plates 7 may be arranged on an end of the plate package 2 that lacks portholes or on which each or at least one porthole 6 is located intermediate the mounting plates 7.

The invention claimed is:

1. A plate heat exchanger, comprising:

a plurality of heat exchanger plates which are stacked and permanently connected to form a plate package that defines first and second fluid paths for a first medium and a second medium, respectively, separated by said heat exchanger plates, said plate package defining a surrounding external wall that extends in an axial direction between first and second axial ends, an end plate permanently connected to one of the first and second axial ends so as to provide an end surface that extends between first and second longitudinal ends in a lateral plane which is orthogonal to the axial direction, and two mounting plates permanently connected to a respective surface portion of the end surface at the first longitudinal end and the second longitudinal end, respectively, such that the mounting plates are spaced from each other in a longitudinal direction on the end surface, wherein the respective mounting plate comprises opposing flat engagement surfaces and a peripheral edge that forms a perimeter of the mounting plate, wherein the respective mounting plate is arranged with one of its engagement surfaces permanently connected to the end surface, wherein the peripheral edge partially extends beyond the outer periphery of the end surface, so as to define a mounting flange, and partially extends across the end surface in contact with the same, and wherein the mounting plate has a decreasing thickness towards the peripheral edge in predefined intersection regions, which are located where the peripheral edge intersects with the perimeter of the surrounding external wall as seen in a normal direction to the end surface, where the decreasing thickness is formed by recesses in the respective mounting plate, wherein the respective recess is formed to extend within each of the predefined intersection regions between the engagement surface that faces away from the end surface and the peripheral edge, as seen in the normal direction to the end surface.

2. The plate heat exchanger of claim 1, wherein the respective intersection region has a predefined cross-sectional shape which connects the engagement surfaces by reducing the thickness of the mounting plate from a first thickness, given by the distance between the engagement surfaces, to a second thickness at the peripheral edge.

3. The plate heat exchanger of claim 2, wherein the cross-sectional shape comprises a portion with continuously decreasing thickness towards the peripheral edge.

4. The plate heat exchanger of claim 2, wherein the cross-sectional shape comprises a concave portion.

5. The plate heat exchanger of claim 2, wherein the cross-sectional shape comprises a corner portion having a radius.

6. The plate heat exchanger of claim 5, wherein the ratio between the radius and the first thickness is in the range of about 0.2-1.

7. The plate heat exchanger of claim 2, wherein the cross-sectional shape comprises at least one of a bevel and a plurality of steps.

8. The plate heat exchanger of claim 1, wherein the respective recess extends along the peripheral edge, as seen in the normal direction to the end surface.

9. The plate heat exchanger of claim 8, wherein the mounting plate, intermediate the recesses along the peripheral edge, comprises a peripheral edge surface which joins and is essentially perpendicular to the opposing engagement surfaces, and wherein the recesses are located along a shoulder between the engagement surface that faces away from the end surface and the peripheral edge surface.

10. The plate heat exchanger of claim 1, wherein the respective recess defines a border line to the engagement surface that faces away from the end surface, said border line defining an intersection point with the perimeter of the surrounding external wall, as seen in the normal direction to the end surface, wherein the tangent of the border line at the intersection point defines an angle a that exceeds 0°, and preferably is at least 1°, 5° or 10°, to a transverse direction, which is orthogonal to the longitudinal direction, in the plane of the mounting plate.

11. The plate heat exchanger of claim 10, wherein the recess has essentially the same cross-sectional shape, as seen at right angles to the border line, along the border line.

12. The plate heat exchanger of claim 10, wherein the border line comprises an essentially straight line that defines said tangent.

13. The plate heat exchanger of claim 10, wherein the border line is an essentially straight line.

14. The plate heat exchanger of claim 1, wherein the respective recess extends from the intersection region into the mounting flange.

15. The plate heat exchanger of claim 1, wherein the end plate is a sealing plate which is permanently and sealingly connected to one of the heat exchanger plates at one of said first and second axial ends.

16. The plate heat exchanger of claim 1, wherein the end plate is a reinforcement plate which is permanently connected to a sealing plate on the plate package, wherein the end plate has at least two supporting flanges that extend beyond the perimeter of the surrounding external wall so as to abut on the mounting flange defined by the respective mounting plate.

17. The plate heat exchanger of claim 16, wherein the end plate comprises, along its perimeter and as seen in the normal direction of the end surface, concave or beveled surfaces adjacent to the supporting flanges, wherein the concave or beveled surfaces are located to overlap the peripheral edge of the respective mounting plate in the proximity of the intersection regions, and wherein the respective concave or beveled surface is non-perpendicular to the peripheral edge at the overlap, as seen in the normal direction to the end surface.

18. The plate heat exchanger of claim 1, wherein at least one of the mounting plates defines at least one through hole that extends between the engagement surfaces and is aligned with a corresponding through hole defined in the end plate and an internal channel defined in the plate package, so as to form an inlet or an outlet for the first or the second medium.

19. The plate heat exchanger of claim 1, wherein the mounting flange comprises a plurality of mounting holes adapted to receive bolts or pins for fastening the plate heat exchanger.

20. The plate heat exchanger of claim 1, wherein the heat exchanger plates are permanently joined to each other through melting of metallic material.

* * * * *